US006279573B1

(12) United States Patent
Johnson et al.

(10) Patent No.: US 6,279,573 B1
(45) Date of Patent: Aug. 28, 2001

(54) BREATHING TUBE CONNECTION FOR RESPIRATORY PROTECTIVE HEADGEAR

(75) Inventors: Brett R. Johnson; William J. Swanson, both of St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/037,630

(22) Filed: Mar. 10, 1998

(51) Int. Cl.[7] ..... A62B 9/04

(52) U.S. Cl. ..... 128/202.27; 128/205.25; 128/912

(58) Field of Search ..... 128/200.27, 200.28, 128/201.25, 202.27, 205.25, 912; 285/308, 320, 921

(56) References Cited

U.S. PATENT DOCUMENTS

| | | | | |
|---|---|---|---|---|
| 999,169 | * | 7/1911 | Jones | 285/320 |
| 2,052,046 | * | 8/1936 | Lambie | 285/308 |
| 2,453,475 | * | 11/1948 | Tobias | 128/202.27 |
| 3,736,927 | | 6/1973 | Misaql | 128/145.6 |
| 3,921,223 | | 11/1975 | Hoyecki | 2/8 |
| 3,963,021 | | 6/1976 | Bancroft | 128/145 R |
| 4,111,197 | * | 9/1978 | Warncke et al. | 128/202.27 |
| 4,458,719 | * | 7/1984 | Strybel | 285/320 |
| 4,590,951 | * | 5/1986 | O'Connor | 128/201.25 |
| 4,669,755 | * | 6/1987 | Harris et al. | 285/320 |
| 4,676,236 | | 6/1987 | Piorkowski et al. | 128/201.23 |
| 4,793,342 | * | 12/1988 | Haber et al. | 128/202.27 |
| 4,841,953 | * | 6/1989 | Dodrill | 128/202.25 |
| 4,996,981 | | 3/1991 | Elenewski et al. | 128/201.15 |
| 4,997,217 | * | 3/1991 | Kunze | 128/912 |
| 5,054,479 | | 10/1991 | Yelland et al. | 128/201.25 |
| 5,150,880 | * | 9/1992 | Austin, Jr. et al. | 285/320 |
| 5,188,400 | * | 2/1993 | Riley et al. | 285/921 |
| 5,323,808 | * | 6/1994 | Shimizu | 285/320 |
| 5,394,870 | * | 3/1995 | Johansson | 128/201.25 |
| 5,427,090 | | 6/1995 | Hipskind et al. | 128/205.12 |
| 5,452,713 | * | 9/1995 | Vipond et al. | 128/202.27 |
| 5,549,104 | | 8/1996 | Crump et al. | 128/201.25 |
| 5,568,946 | * | 10/1996 | Jackowski | 285/308 |
| 5,775,323 | * | 7/1998 | Knott | 128/202.27 |
| 5,829,431 | * | 11/1998 | Hannah et al. | 128/205.25 |

FOREIGN PATENT DOCUMENTS

| | | | | |
|---|---|---|---|---|
| 410311 | * | 4/1925 | (DE) | 128/202.27 |
| 2609034 | * | 9/1977 | (DE) | 128/202.27 |
| 0 090 083 A2 | | 10/1983 | (EP) . | |
| 0 394 139 A1 | | 10/1990 | (EP) . | |
| 0 521 800 A1 | | 1/1993 | (EP) . | |

OTHER PUBLICATIONS

Product information: *3M Positive Pressure Respirators*, 3M Occupational Health and Environmental Safety Division, Dec., 1996.
Brochure: "Powered Respirators," Racal Health & Safety, (undated).
Product Information: "Pureflo Powered Respirators," Helmet Integrated Systems Ltd., 13 pages.
Product information: "Cobra Powered Helmet Respirators," MSA.
Product Information: "AH29 Air Supplied Airstream," Airstream Anti Dust Helmet, Racal.
Product Information: "The Dustmaster System," Arco.
Product Information: "Breathe Easy Plus," 1 BE1+ Helmet System, Racal.
Product Information: Helmet product literature, Kasco, 7 pages.

* cited by examiner

*Primary Examiner*—Aaron J. Lewis
(74) *Attorney, Agent, or Firm*—Michaele A. Hakamaki

(57) ABSTRACT

A connector for attachment of a breathing tube to a respirator. The connector includes a first conduit and a transition conduit that form a connector body. A cantilevered snap latch extends from the connector body. A connector assembly including a recessed receiving structure on a respirator helmet adapted for receiving the connector.

10 Claims, 3 Drawing Sheets

BREATHING TUBE CONNECTION FOR RESPIRATORY PROTECTIVE HEADGEAR

FIELD OF THE INVENTION

This invention relates to respirator breathing systems and more particularly to connectors for attaching an air supply tube to a respirator.

BACKGROUND

Respirators are frequently worn by people working in areas where the air may be contaminated with toxic or noxious substances such as particulates, gases and vapors. For example, the air in a sanding or grinding area may contain airborne particulates, the air in a painting area may contain droplets of paint or solvent vapors, and the air in a welding area may contain harmful particles or fumes.

The respirator may filter the air or it may provide a supply of uncontaminated air. A positive pressure respirator has a source of clean air brought into the mask under positive pressure, giving a higher pressure inside the mask of the respirator than in the surrounding ambient air. The source of clean air may include blowing or pulling ambient air through a filter or it may include bringing clean air in from an external source, A positive pressure respirator usually employs a breathing tube to direct the clean air into the breathing zone of the respirator. Because the breathing tube is a source of clean air, the security of the attachment of the breathing tube to the headgear is important. Potential hazards include objects that may catch on the latch, thereby leading to a risk that the tube becomes separated from the respirator.

Various governmental agencies and industry organizations have established regulations specifying standards that must be met by this connection under certain use conditions. For example, the European Committee for Standardization requires that the connection must withstand a pulling force of 25 kilograms, or approximately 56 lbs. of pressure (CEN Type 3).

A common attachment method currently in use with respiratory devices involves a rigid cylindrical fitting projecting from the headgear to which the breathing tube is attached. This attachment typically employs a rigid cylindrical fitting on the end of the breathing tube. For example, U.S. Pat. No. 4,996,981 describes a respiratory device in which the device includes an aperture or orifice into which a hose is fitted in sealing relation. Other similar examples are disclosed in U.S. Pat. Nos. 3,736,927; 3,963,021; and 4,676,236. Similarly, U.S. Pat. No. 3,921,223 describes a rearwardly extending nipple that is designed to engage the end of a tube, which is made of flexible plastic or rubber material. The attachment fitting or nipple may also be ribbed or tapered.

Various clamping devices have been used to provide a more secure attachment of the breathing tube to the respirator. For example, in U.S. Pat. No. 5,549,104 a breathing tube is secured in a sleeve by means of a clamp that encircles the sleeve overlying an end portion of the tube. Other clamps have also been used, including pinch clamps, clamps tightened with a screwdriver, and clamps tightened with a thumbscrew. Compression fittings tightened by a threaded retainer have also been used.

SUMMARY

There is a need in the art for a respirator connector that is protected from accidental disconnection. It is desirable that the connector be suitable for use in various types of respirators and yet be relatively easy for the wearer of the respirator to connect and disconnect from the respirator. While providing the aforementioned advantages, the connector should be capable of withstanding a relatively substantial pull-off pressure.

In one aspect of the present invention, a respirator connector for a breathing tube includes a first conduit, a transition conduit, and a cantilevered snap latch that extends therefrom. The snap latch has a locking member for engaging a receiving structure on a respirator.

In another aspect of the present invention, a connector assembly for connecting a breathing tube to a respirator includes a respirator having a recessed receiving structure, said recessed receiving structure adapted for receiving a connector. The receiving structure includes a protruding member for engaging a locking member on the connector. The connector includes a first air conduit and a transition conduit between the air conduit and the breathing tube. The first conduit, transition conduit and breathing tube comprises an air conduit. A cantilevered snap latch, including a locking member, extends from the connector. Preferably, the connector is capable of withstanding a pull-off force of about 25 kilograms or 56 lbs.

The recessed receiving structure of the present invention is formed or disposed within a respirator, such as a helmet or full-face respirator. The recessed receiving structure includes an air inlet for supplying air from the breathing tube to the respirator breathing zone. The protruding member of the recessed receiving structure engages the locking member disposed on the cantilevered snap latch.

The first conduit is shaped to fit within the air inlet receptacle in the respirator. The first conduit is substantially disposed within the receptacle when attached. Preferably, the first conduit is a flat conduit.

The transition conduit of the connector may include a base and a body. Preferably, the body protrudes from the base at an angle, such that the axis formed by the air conduit comprising the first conduit, transition conduit, and breathing tube is non-linear.

The cantilevered snap latch includes a latch base and a latch body. Latch body further includes a locking member. Preferably, the snap latch is attached or molded with the first conduit or transition conduit. The latch body depends therefrom and forms an angle with the first conduit. Reinforcing members may be formed with the snap latch to assist in securing the latch to the respirator. Preferably, the snap latch, when attached to the respirator, is disposed substantially within the receiving.

The recessed receiving structure, flattened profile, and nonlinear connection angle provide a low profile for the helmet and an attractive appearance. The lower helmet profile allows the helmet to be smaller, reducing both bulk and weight. The cantilevered snap latch resides in a recessed area of the helmet to avoid snagging or inadvertent catching when worn in close quarters. The cantilevered latch is capable of meeting CEN Type 3 standards. However, the snap latch may be easily disconnected by the wearer, without the necessity of using tools or otherwise performing a complicated procedure.

While flattening the profile of the connector, a large cross-sectional area of the air conduit is maintained, thus maintaining minimal pressure drop or flow resistance of the air. This structure therefore provides greater air flow for increased wearer comfort and longer battery life for those systems using battery powered fans to supply the filtered breathing air.

DETAILED DESCRIPTION OF THE PREFERRED EMBODIMENTS

In describing preferred embodiments of the invention, specific terminology is used for the sake of clarity. The invention, however, is not intended to be limited to the specific terms so selected, and it is to be understood that each term so selected includes all technical equivalents that operate similarly.

Figure 1:
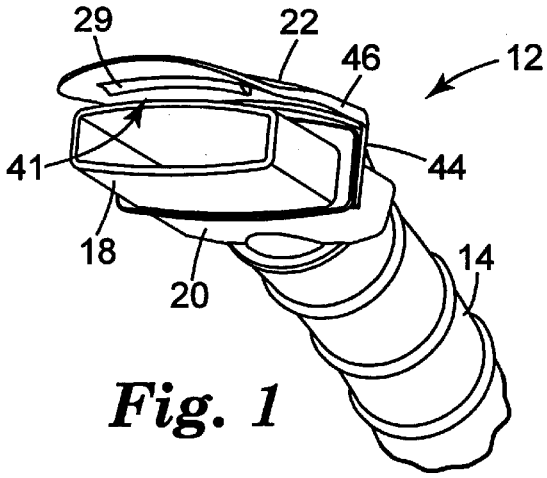
FIG. 1 is a front perspective view of a connector of the present invention.
Figure 2:
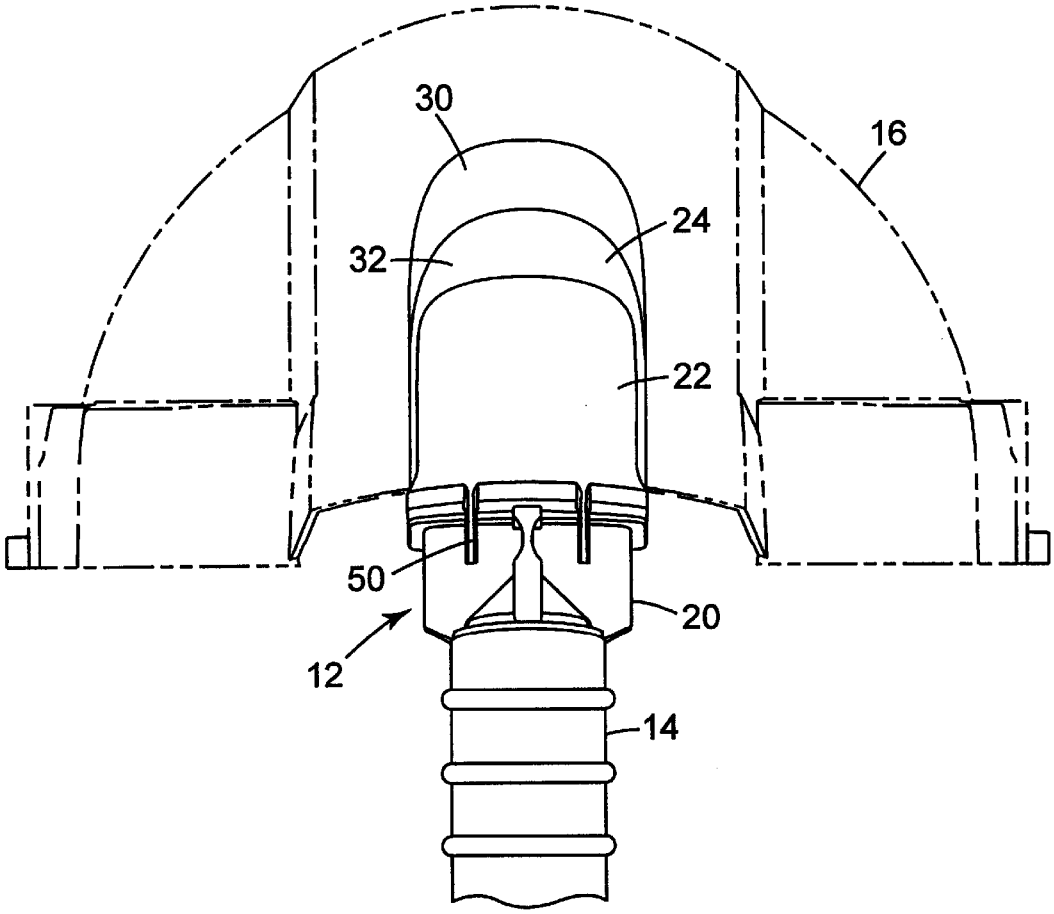
FIG. 2 is a front plan view of a recessed receiving structure with a connector of the present invention attached thereto.

Referring to FIGS. 1 and 2, the present invention includes a connector 12 for use in attaching a breathing tube 14 with a respirator 16. The connector 12 is suitable for use with positive pressure respirators, wherein an air supply is provided by an external source. The connector 12 may be used both with respirators having helmets and full-face respirators.

The connector 12 includes a first conduit 18, transition conduit 20 and cantilevered snap latch 22 attached thereto. The first conduit 18 and transition conduit 20 form a connector body. The first conduit 18, transition conduit 20 and breathing tube 14 form an air conduit.

With continuing reference to FIG. 1, the present invention may further include a recessed receiving structure 24 on the respirator 16. In FIG. 2, a helmet respirator is depicted. Many of these types of respirators are known in the art, such as the Whitecap I™ and Whitecap II™ available from 3M of St. Paul, Minn. The connector may also be adapted for use with full face respirators.

Figure 3A:
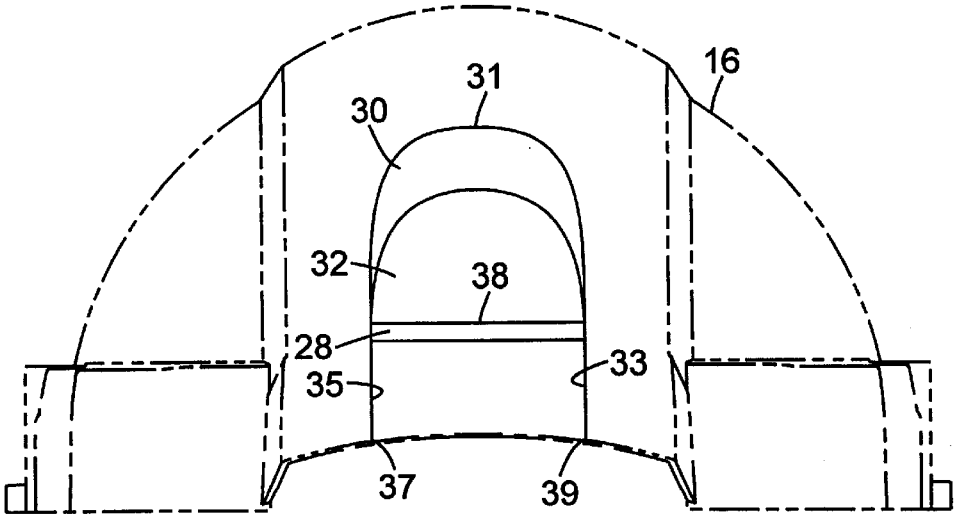
FIG. 3*a* is a front plan view of a recessed receiving structure.
Figure 3B:
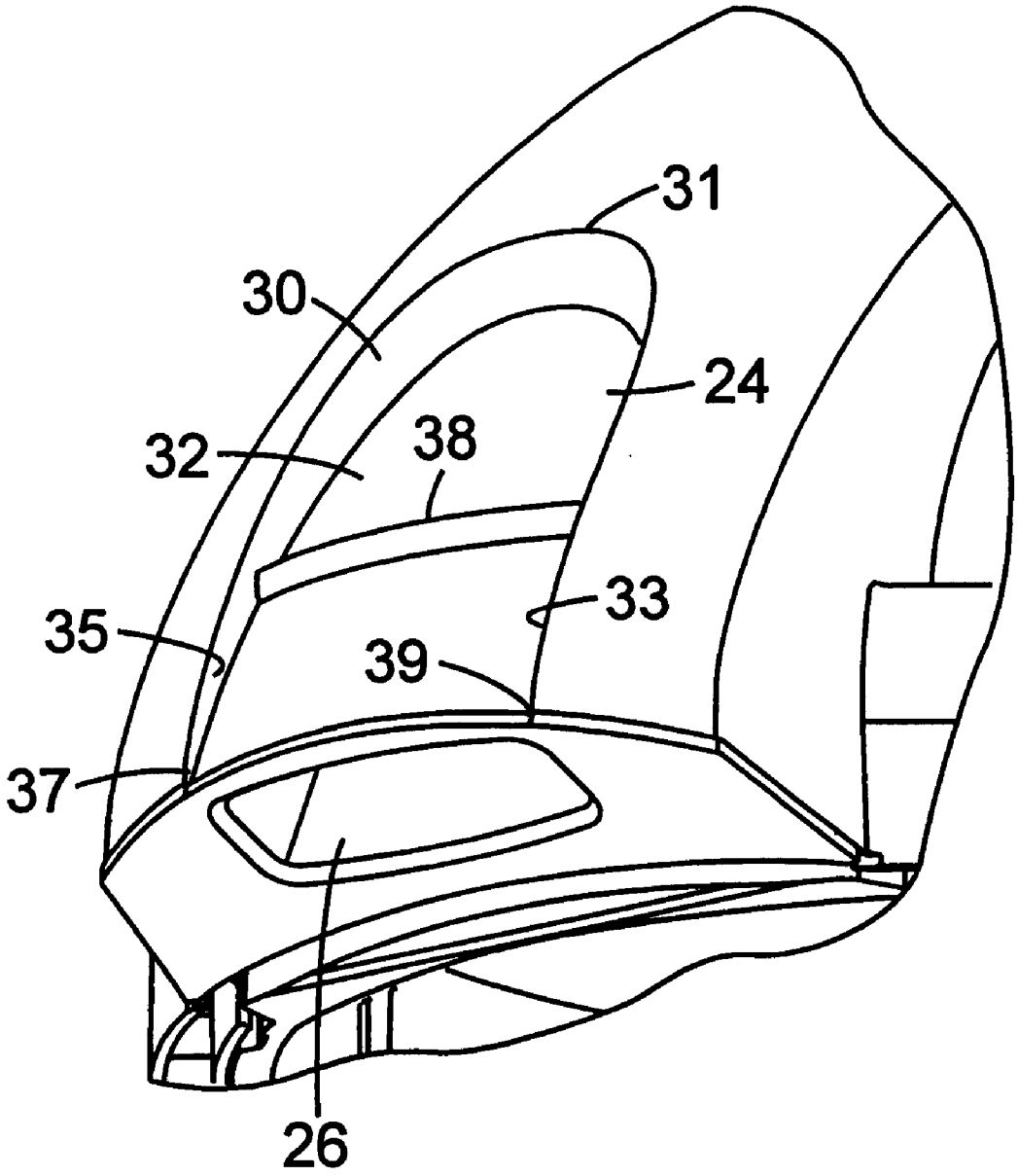
FIG. 3*b* is a front perspective view of the recessed receiving structure of FIG. 3*a*.

Referring to FIGS. 2, 3*a*, and 3*b*, the receiving structure 24 is preferably located on the back of the respirator 16. The receiving structure 24 includes an air inlet 26, protruding member 28, wall 30 and floor 32.

Air inlet 26 provides a source of clean air to the respirator breathing zone by way of a conduit (not depicted). Air inlet 26 typically opens in the back and bottom of the respirator 16. The air inlet 26 may be protected by the respirator 16 or by structures affixed to the respirator 16. The air source (not depicted) is external to the respirator 16. The air source may be battery powered and contained within a portable system.

Wall 30 is preferably U-shaped, having a top 31 and two sides 33, 35, with each side having an end 37, 39. The top 31 of wall 30 may be deeper than the ends 37, 39 of wall 30. The width between sides 33, 35 may vary. Preferably, wall 30 has a width sufficient to permit the average male to insert three fingers between sides 33, 35.

The protruding member 28 is provided within the receiving structure 24. Protruding member 28 is adapted to engage and hold locking member 29 on cantilevered snap latch 22, as explained more fully below. Accordingly, the protruding member 28 may take a variety of shapes and forms. For example, protruding member 28 may extend from wall 30, without contacting floor 32. Protruding member 28 may also extend across floor 32 without contacting wall 30. However, in a preferred embodiment, the protruding member 28 extends across floor 32 and contacts sides 33, 35. One skilled in the art will appreciate that other locking systems may be suitable for use herein, such as snap connectors, without departing from the spirit and scope of the present invention.

In a preferred embodiment, lip 38 of protruding member 28 forms an angle of less than 90° with floor 32. Lip 38 engages locking surface 41 of locking member 29 on cantilevered snap latch 22 to lock connector 12 on recessed receiving structure 24, as more fully discussed below.

Figure 4:
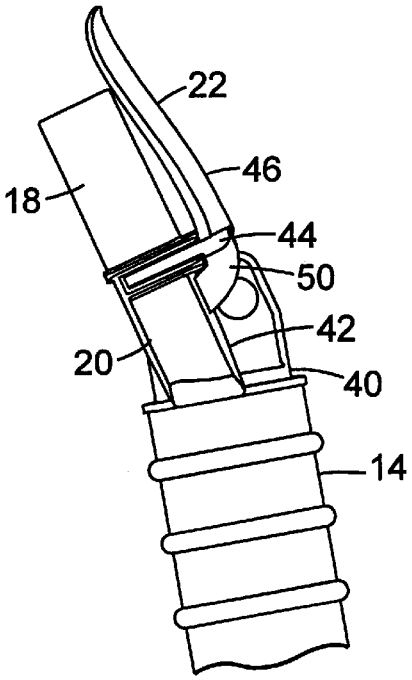
FIG. 4 is a side plan view of a connector of the present invention.
Figure 5:
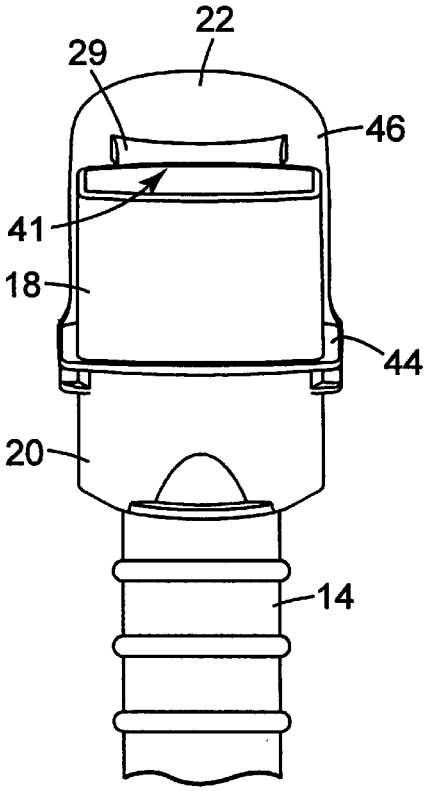
FIG. 5 is a bottom plan view of a connector of the present invention.

With reference to FIGS. 4 and 5, first conduit 18 is shaped to be inserted into air inlet 26. In a preferred embodiment, the first conduit 18 is flat. However, one skilled in the art will appreciate that other conduit shapes may be suitable for use herein, without departing from the spirit and scope of the invention.

Transition conduit 20 is attached to first conduit 18 and breathing tube 14. Preferably, transition conduit 20 includes a base 40 and a body 42. Base 40 is attached, either permanently or removably, to breathing tube 14. Preferably, base 40 is oval shaped. Base 40 is also preferably shaped so that body 42 extends at an angle from base 40 as depicted in FIG. 4. Accordingly, the axis formed by the air conduit comprising the first conduit 18, transition conduit 20, and breathing tube 14 is preferably non-linear. This non-linearity may be optimized to enhance the drape of breathing tube 14 from the respirator 16 when the respirator 16 is in use.

Transition conduit 20 is preferably generally rectangular in shape. The cross-sectional area of the transition conduit is optimized such that it is not substantially smaller than the cross-sectional area of the breathing tube. Optimization of the cross-sectional area in this manner thereby minimizes pressure drop or flow resistance of the air through the air conduit. Further, the rectangular shape flattens the profile of the assembly. In a preferred embodiment and as depicted in FIG. 2, transition conduit 20 does not mate with recessed receiving structure 24.

Cantilevered snap latch 22 is attached to the connector. Preferably, latch 22 is disposed between first conduit 18 and transition conduit 20. Cantilevered snap latch 22 includes a latch base 44 and latch body 46. Latch base 44 extends from either the first conduit 18 or the transition conduit 20. In a preferred embodiment, latch base 44 extends from transition conduit 20.

Latch body 46 extends towards first conduit 18 at an angle from latch base 44. Latch body 46 preferably has rounded edges.

With reference to FIGS. 1 and 5, cantilevered latch includes locking member 29 disposed thereon. Preferably, locking member 29 is disposed underneath the latch body 46 and extends across the width the latch body 46. Locking member 29 has locking surface 41 that forms an angle of less than 90° with undersurface of latch body 46. Preferably, the angle of locking surface 41 is optimized to engage the lip 38 of protruding member 28. When engaged, a substantial pull down force on the connector 12 is required to disengage the lip 38 from the locking surface 41. Preferably, the connector 12 can withstand a pull off force of about 25 kilograms. However, the cantilevered snap latch 22 and recessed receiving member 24 permit the wearer of a respirator 16 to remove the connector with relative ease by inserting his or her fingers under the latch 22 and lifting the latch 22 away from the recessed receiving member 24, thus disengaging the locking surface 41 from the lip 38. Consequently, disconnection is not a complicated procedure and does not require the use of two hands.

When connected, the snap latch 22 is disposed substantially within the recessed receiving member 24 and therefore does not present many exposed edges above or out of the recessed receiving member 24 that may be accidentally snagged.

The latch 22 may be constructed of a variety of materials that provide sufficient strength characteristics, such as polycarbonate/polyester blends. A preferred material is sold under the trademark Xenoy™ by the General Electric Company.

Reinforcing members 50 may be provided snap latch 22 to lend rigidity to the latch 22.

The following example illustrates an aspect of the present invention but is not intended to be limiting thereof.

EXAMPLE

A connector assembly as described above was tested for pull-off force. The connector has a first conduit and a transition conduit. A cantilevered snap latch was attached to the transition conduit. The cantilevered snap latch had a locking member disposed on its underside. The connector was attached to an independently supported helmet respirator via a recessed receiving member. The recessed receiving member had a protruding member that corresponded to the locking member. A pail was attached by a strap to the transition conduit with a screw through the transition conduit. The pail was filled with scrap metal weighing 25 kilograms (56 lbs.) and subsequently 39 kilograms (86 lbs). The attachments of the connector to the respirators were timed for ten seconds. The attachments met the CEN Type 3 standard because none of the connectors disconnected during the ten second periods. The CEN Type 3 standard requires that a connector remain attached for ten seconds at a weight of 25 kilograms (56 lbs).

The full disclosure of all patents and patent applications referred to in the detailed description of the preferred embodiments of this specification are incorporated herein by reference as if individually incorporated.

Although various embodiments of the invention have been described in detail in the foregoing for purposes of illustration, it is to be understood that such details are solely for that purpose and that variations may be made therein by those skilled in the art without departing from the spirit and scope of the invention as described in the following claims.

We claim:

1. A connector assembly for connecting a breathing tube to a respirator, comprising, a respirator having a recessed receiving structure, said recessed receiving structure having a wall, a floor, and a protruding member for engaging a connector, wherein the protruding member extends across at least a portion of the floor, and a connector for mating with the receiving structure, said connector including a first air conduit, a transition conduit formed with said first air conduit, a cantilevered snap latch extending therefrom, said cantilevered snap latch having a latch base, a latch body hingedly connected to the latch base and extending from the latch base at an angle toward the first air conduit, and a locking member for engaging said protruding member.

2. The connector assembly of claim 1 wherein said transition conduit includes a breathing tube attached thereto.

3. The connector assembly of claim 1 wherein said first conduit, said transition conduit and said breathing tube form a non-linear axis.

4. The connector assembly of claim 1 wherein the cantilevered snap latch further comprises a reinforcing member.

5. The connector assembly of claim 1 wherein the respirator includes a helmet.

6. The connector assembly of claim 1 wherein the transition conduit is generally rectangular in shape.

7. The connector assembly of claim 1 wherein the transition conduit includes a base and body, wherein said body extends at an angle away from said base.

8. The connector assembly of claim 1 wherein said connector is capable of withstanding a pull-off force of about 25 kilograms.

9. The connector assembly of claim 1 wherein the protruding member includes a lip.

10. The connector assembly of claim 9 wherein the locking member includes a locking surface and said lip engages said locking surface.

* * * * *